United States Patent [19]

Masovich et al.

[11] Patent Number: 4,648,659

[45] Date of Patent: Mar. 10, 1987

[54] METHOD AND HYDRAULIC SYSTEM FOR CONTROLLING SUPPLY OF FLUID TO COMBINE FOR EXTRACTING MINERALS

[75] Inventors: Felix Z. Masovich; Vladimir V. Starichnev, both of Moscow, U.S.S.R.

[73] Assignee: Gosudarstvenny Proektno-Konstruktorsky I Experimentalny Institut Ugolnogo Mashinostroenia "Giprouglemash", Moscow, U.S.S.R.

[21] Appl. No.: 648,154

[22] PCT Filed: May 27, 1983

[86] PCT No.: PCT/SU83/00011

§ 371 Date: Aug. 21, 1984

§ 102(e) Date: Aug. 21, 1984

[87] PCT Pub. No.: WO84/02739

PCT Pub. Date: Jul. 19, 1984

[30] Foreign Application Priority Data

Jan. 11, 1983 [SU] U.S.S.R. ..... 3528701

[51] Int. Cl.[4] ..... E21C 27/36; E21C 35/22; E21F 5/02

[52] U.S. Cl. ..... 299/1; 299/12; 299/81; 299/42

[58] Field of Search ..... 299/12, 42, 81, 17, 299/1

[56] References Cited

U.S. PATENT DOCUMENTS 3,980,338 9/1976 Weber ..... 299/1

FOREIGN PATENT DOCUMENTS 2638445 3/1978 Fed. Rep. of Germany ..... 299/1
2631585 10/1980 Fed. Rep. of Germany .
254436 3/1970 U.S.S.R. .
576422 10/1977 U.S.S.R. ..... 299/1
752042 7/1980 U.S.S.R. ..... 299/1

*Primary Examiner*—Stephen J. Novosad
*Assistant Examiner*—Michael A. Goodwin
*Attorney, Agent, or Firm*—Lilling & Greenspan

[57] ABSTRACT

A method for controlling the supply of fluid to a combine, wherein fluid is fed for actuating hydraulic cylinders 14, 15 of the drive for moving the combine and to a dust suppression hydraulic system 1. The same fluid, which is discharged from the hydraulic cylinders 14, 15, is used for feeding it at a pre-set pressure to the hydraulic system 1 for emergence under the flowthrough conditions. For that purpose, the dust suppression hydraulic system 1 communicates, via a fluid distributor 13, with the hydraulic cylinders 14, 15 to define an open-circuit hydraulic system.

8 Claims, 1 Drawing Figure

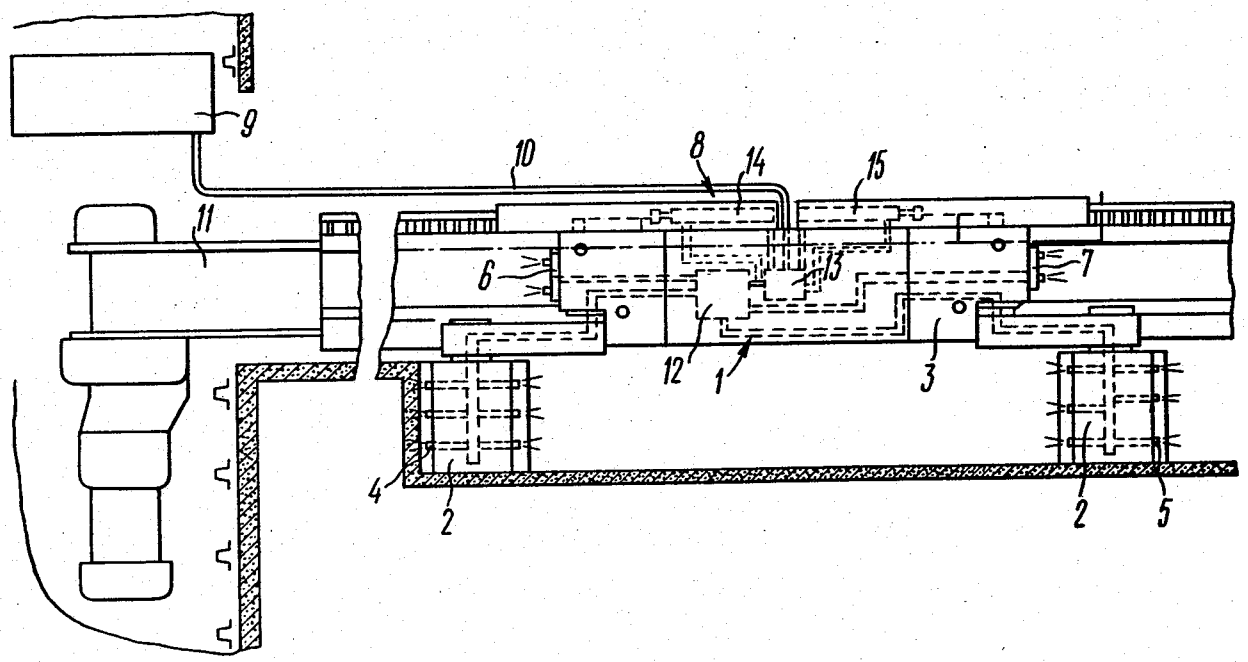
1
2
2
3
4
5
6
7
8
9
10
11
12
13
14
15

METHOD AND HYDRAULIC SYSTEM FOR CONTROLLING SUPPLY OF FLUID TO COMBINE FOR EXTRACTING MINERALS

BACKGROUND OF THE INVENTION

FIELD OF THE INVENTION

The invention relates to mining engineering, and more specifically it deals with a method and hydraulic system for controlling the supply of fluid to a combine for extracting minerals.

DESCRIPTION OF THE PRIOR ART

At present combines for extracting minerals are widely used which have a dust suppression and electric motor water cooling system, the water being supplied from the gallery by a constant capacity pumping unit through a line laid alongside the main conveyer. Water supplied to the combine through respective pipe-lines and also partially through the water jackets of electric motors is fed to the nozzles of the dust suppression system and is sprayed therethrough to broken coal. However, with such a method of water supply, the constant capacity pumping unit would normally give a high flow rate designed for the maximum output of the combine which can only be reached at maximum movement speed of the combine. As the combines would normally operate at speeds lower than the maximum speed of feed, water would be supplied to the combine in an amount which is much greater than that necessary for efficient dust suppression. This is harmful for both the working conditions of the operating personnel and quality of the coal being extracted.

The combine also has a hydraulic drive for moving the combine along the face, comprising a pump installed on the combine and a hydraulic motor supplied by this pump. The pump is rather complicated requiring an individual hydraulic system for supplying fluid thereto, and not infrequently it is cause of lower output of the combine. Oil or oil suspension is generally used in the hydraulic mechanism as fluid, whereas water or water with additives improving dust wetting capacity is used for the dust suppression. Thus individual systems for supplying fluids are required thus making the combine more complicated and increasing its size which is of particular importance in working small-thickness seams.

SUMMARY OF THE INVENTION

The invention is based on the problem of providing a method and hydraulic system for controlling the supply of fluid to a combine for extracting minerals in which a hydraulic system of a combine simple in design would provide for controlling the amount of fluid fed to the dust suppression system in accordance with the speed of the combined movement along the face.

The invention resides in a method for controlling the supply of fluid to a combine for extracting minerals, comprising feeding the fluid positively and alternately to hydraulic cylinders of a drive for moving the combine along the face for alternately actuating them, and also to a dust supression system. According to the invention, the fluid for the power hydraulic cylinders and the fluid for the dust suppression is one and the same fluid which is supplied from the hydraulic cylinders, after actuation thereof, at a pre-set pressure to the dust suppression hydraulic system for emergence of the fluid under the flowthrough conditions.

The use of one and the same fluid, fed from the outside under the flowthrough conditions, for actuating the drive of the combine movement and for subsequent use in the dust suppression hydraulic system makes it possible to reduce the combine size (owing to the installation of the pump in the gallery) and to supply the dust suppression system with clean fluid at a desired pressure and in an amount corresponding to, and depending on the combine movement speed, i.e. on the amount of a mineral being extracted.

A pre-set pressure in the dust suppression hydraulic system is preferably maintained at a varying fluid flow rate depending on the speed of the combine movement along the face.

Maintaining a pre-set pressure in the dust suppression hydraulic system at a varying fluid independent flow rate of the combine movement speed ensures the maximum possible efficiency of dust suppression which can only be achieved at the pre-set pressure.

The fluid preferably comprises water in a composition used for the dust suppression.

The use of water in a composition used for the dust suppression (e.g. with additives improving wetting of dust) makes it possible to connect the combine to the pumping unit by means of a single hose since no fluid return circuit is necessary in that case.

The method for controlling the supply of fluid to a combine for extracting minerals is used in a hydraulic system of a combine for extracting minerals, comprising a line for supplying fluid which is connected, via a fluid distributor, to at least two power hydraulic cylinders of a drive for moving the combine along the face, and a dust suppression hydraulic system, wherein, according to the invention, the dust suppression hydraulic system communicates, via the fluid distributor, with the power hydraulic cylinder so as to define an open-circuit hydraulic system in which the fluid for the power hydraulic cylinders and the fluid for the dust suppression is one and the same fluid so that the fluid discharged from the hydraulic cylinders is fed to the dust suppression hydraulic system.

The use of such a hydraulic system makes it possible to reduce the combine size and the number of hoses connecting the combine to the pumping unit and to supply the dust suppression system with clean water in an amount corresponding to the amount of a mineral being extracted.

The dust suppression hydraulic system preferably comprises a flow regulator which is designed for maintaining a pre-set pressure in the dust suppression hydraulic system at varying fluid flow rate depending on the speed of the combine movement along the face. In case where the dust suppression hydraulic system comprises a plurality of nozzles installed on the combine, the flow regulator is preferably provided with means for shutting-off fluid supply to the nozzles and is adapted to maintain a preset pressure in the dust suppression hydraulic system by shutting-off a number of nozzles.

The flow regulator ensures the maintenance of a preset pressure at the nozzles of the dust suppression system independent of the combine movement speed, i.e. independent of the fluid flow rate thereby ensuring the maximum possible dust suppression efficiency.

BRIEF DESCRIPTION OF THE DRAWING

The invention will now be described with reference to a specific embodiment thereof illustrated by the drawing schematically showing a hydraulic system for carrying out a method for controlling the supply of fluid to a combine for extracting minerals according to the invention.

DESCRIPTION OF A PREFERRED EMBODIMENT OF THE INVENTION

A method for controlling the supply of fluid to a hydraulic dust suppression system and to a hydraulic system for the combine movement will be described as applied to the use thereof in a stopping combine.

A dust suppression hydraulic system 1 is disposed on working members 2 and housing 3 of the combine. The dust suppression hydraulic system comprises units of sprinkling nozzles 4, 5, 6, 7, the units 4 and 5 being installed on the working members 2 and the units 6 and 7, on the housing 3 of the combine. The housing 3 of the combine has hydraulic drive 8 for its movement.

A variable capacity pump 9 is disposed outside the working range of the combine, in this case in a gallery, to pump fluid, e.g. water, to the combine through a line 10 laid alongside a main conveyor 11. After actuating the hydraulic movement drive 8, water is fed, via a flow regulator 12 and a fluid distributor 13, to the dust suppression system 1.

Fluid, e.g. water, is fed under pressure to the movement drive 8 having power hydraulic cylinders 14, 15 and actuates it, the combine feed speed being controlled by varying the capacity of the pump 9. The fluid may also comprise water with wetting additives used for improving the dust suppression efficiency. Waste water from the power hydraulic cylinders 14, 15 is then fed, via the fluid distributor 13, to the flow regulator 12 which, depending on the change in the amount of water supplied thereto (i.e. depending on a change in the movement speed, hence in the amount of a mineral being extracted) controls the supply to establish the necessary flow rate level and directs water to one or other number of units 4, 5, 6, 7 so that a pre-set pressure is maintained at the nozzles of these units in any case. At the same time, this results in a change in the amount of water fed for the dust suppression depending on the amount of a mineral being extracted (i.e. depending on the combine movement speed). Thus, at the maximum combine movement speed, maximum water flow rate is required both for the combine movement and for the dust suppression. In this case the flow regulator 12 will direct water to all the units 4, 5, 6, 7. At a minimum movement speed the amount of water required for both functions decreases, and the flow regulator 12 will direct water only to the units 4, 5 disposed on the working members 2. Minimum water flow will be maintained through the disconnected units 6, 7 so as to prevent them from being clogged.

The method according to the invention substantially resides in that fluid is positively and alternately supplied to the power hydraulic cylinders 14, 15 for alternately actuating them and for effecting the combine movement along the face, whereafter the same fluid, e.g. water is fed at a pre-set pressure to the dust suppression hydraulic system 1 for the emergence under the flowthough conditions. The pre-set pressure in the dust suppression hydraulic system is maintained at varying fluid flow rate in accordance with the speed of the combine movement along the face.

For carrying out the method, the combine hydraulic system comprising the line 10, the fluid distributor 13, the hydraulic cylinders 14, 15 of the drive of the combine movement along the face and the dust suppression hydraulic system are made in the form of an open-circuit hydraulic system in which the fluid for the power hydraulic cylinders 14, 15 and the fluid for the dust suppression is one and the same fluid.

Waste fluid from the hydraulic cylinders is fed from the hydraulic cylinders to the dust suppression hydraulic system 1.

The flow regulator 12 for controlling the supply of fluid may be, e.g. of a spool valve type, but it also can be of any other type, provided it is adapted to maintain a pre-set pressure in a hydraulic system by shutting-off nozzles. This facility makes is possible to maintain a necessary pressure at the nozzles at varying fluid flow rate.

The hydraulic system may have a provision for using a part of fluid for cooling electric motors and for actuating a hydraulic system for lifting and lowering the housing 3 of the combine and its working members 2.

The method according to the invention involves the employment in the combine hydraulic system of corrosion resistant members and mechanisms and also of corrosion resistant connecting pipelines. The use of anticorrosion additives of water is undesirable as it may be harmful for the atmosphere in which the operating personnel are working.

The use of the invention makes it possible to bring a successful solution to the following problems:

- a stable supply of the dust suppression system of a combine with clean water at necessary pressure, because the indispensable condition for normal operation of the combine movement drive is a high degree of cleanliness of fluid;
- automatic control of the amount of water supplied for the dust suppression depending on the combine movement speed, i.e. on the amount of coal being extracted;
- simplification of the combine design and reduction of its size owing to the installation of the pump outside the combine.

The economic advantage in using the invention is mainly due to improvement of labour conditions owing to lower dust concentration in the air and reduced flooding of the seam which, in the end, contributes to an improvement of labour productivity in the stoping face.

The invention should be most advantageously used in working coal deposits were intensive and at the same time strictly controlled dust suppression is necessary. This is especially important in small-thickness seams where both inadequate dust suppression and overmoistening will provide unfavourable conditions for operating personnel.

We claim:

1. A method of controlling the supply of fluid to a combine for extracting minerals, comprising the steps of alternately feeding fluid to hydraulic cylinders (14, 15) of a drive (8) for moving the combine along the face for alternately actuating them; and feeding the fluid from the hydraulic cylinders (14, 15) to a dust suppression hydraulic system (1), said dust suppression hydraulic system receiving the fluid at a pre-set pressure after actuation of said hydraulic cylinders (14, 15) for emergence under flowthrough conditions.

2. A method according to claim 1, characterized in that said pre-set pressure in said dust suppression hydraulic system is maintained at varying fluid flow rates which vary as a function of the speed of the combine movement along the face.

3. A method according to claim 2, characterized in that the fluid comprises water in a composition used for the dust suppression.

4. A method according to claim 1, characterized in that the fluid comprises water in a composition used for the dust suppression.

5. A hydraulic system of a combine for extracting minerals, comprising a housing; hydraulic dust suppression means on said housing; hydraulic drive means for driving said housing and moving the combine along the face, said hydraulic drive means including hydraulic cylinders which are alternately actuated; and hydraulic distribution means for feeding fluid from said hydraulic cylinders to said hydraulic dust suppression means, whereby an open-circuit hydraulic system is formed in which the fluid used for said dust suppression means is the same fluid used by and discharged from said hydraulic cylinders, wherein said dust suppression hydraulic means comprises a flow regulator adapted to maintain a pre-set pressure in said dust suppression hyudraulic means at varying fluid flow rates which vary as a function of the speed of the combine movement along the face.

6. A hydraulic system according to claim 5, wherein said dust suppression hydraulic means comprises a plurality of nozzles installed on the combine, wherein said flow regulator (12) has means for shutting-off the supply of fluid to said nozzles and for maintaining a pre-set pressure in said dust suppression hydraulic means by shutting-off a number of nozzles.

7. A hydraulic system as defined in claim 5, further comprising fluid supply means, said hydraulic distribution means comprising a fluid distributor for feeding fluid from said fluid supply means to said hydraulic cylinders.

8. A hydraulic system as defined in claim 7, wherein said fluid supply means comprises a variable capacity pump.

* * * * *